United States Patent [19]

Farnsworth

[11] Patent Number: 5,018,410

[45] **Date of Patent: * May 28, 1991**

[54] WRENCH

[75] Inventor: Dennis G. Farnsworth, Manchester, Mo.

[73] Assignee: Newington Corp., Manchester, Mo.

[ * ] Notice: The portion of the term of this patent subsequent to Jan. 15, 2008 has been disclaimed.

[21] Appl. No.: 439,475

[22] Filed: Nov. 21, 1989

Related U.S. Application Data

[63] Continuation-in-part of Ser. No. 377,552, Jul. 10, 1989.

[51] Int. Cl.[5] ..... B25B 9/00

[52] U.S. Cl. ..... 81/13; 81/55

[58] Field of Search ..... 81/13, 55, 125

[56] References Cited

U.S. PATENT DOCUMENTS

| | | | |
|---|---|---|---|
| 726,782 | 4/1903 | Stone | 81/125 |
| 1,761,988 | 6/1930 | Layhon | 81/125 |
| 2,368,902 | 2/1945 | Thompson | 81/125 |

*Primary Examiner*—James G. Smith

*Attorney, Agent, or Firm*—Senniger, Powers, Leavitt & Roedel

[57] ABSTRACT

A wrench for holding one fastener element of a nut-and-bolt fastener against rotation while the other fastener element is turned to tighten or loosen the fastener. The wrench comprises a wrench plate having a plurality of different size openings for fitting fastener elements (e.g., the bolt) of different sizes, the wrench plate being engageable with an adjacent part when the other fastener element (e.g., the nut) is turned for holding the one fastener element against rotation, and a resilient mateiral affixed to one face of the wrench plate, the resilient material projecting a relatively small distance beyond an edge of each opening for resilient engagement by the one fastener element (e.g., the bolt) when the latter is fitted into the opening. The resilient engagement of the fastener element and the resilient material holding the wrench plate in a fixed, self-retaining position with respect to the one fastener element prior to turning the other fastener element whereby both hands may be used to turn the latter for tightening or loosening the fastener.

10 Claims, 6 Drawing Sheets

1
15
23
11
9
13
5
7
P'
28
17
19
21
25
27

WRENCH

The present application is a continuation-in-part of my application Ser. No. 07/377,552 (filed July 10, 1989).

BACKGROUND OF THE INVENTION

This invention relates generally to hand tools and more particularly to a wrench for holding the bolt, for example, of a nut-and-bolt fastener.

The wrench of the present invention is of the same general type described in my abandoned application, Ser. No. 06/407,836 (filed Aug. 13, 1982). In my prior design, the wrench was held in fixed, self retaining position with respect to one fastener element (such as a bolt or a nut) by a cylindric roller mounted on one face of the wrench plate. The roller could be rotated to engage one of the parts being fastened so that the wrench plate was in clamping engagement with the head of the bolt or with the nut. The requirement of rotating the roller to engage the wrench on the part before tightening the fastener is an extra step which detracts from the convenience of using the wrench. Further, in many applications it is difficult to reach the wrench once applied to the bolt or nut to rotate the roller.

SUMMARY OF THE INVENTION

Among the several objects of this invention may be noted the provision of a wrench which holds one fastener element of a nut-and-bolt type fastener against rotation and leaves both hands free to turn the other fastener element to tighten or loosen the fastener; the provision of such a wrench which resiliently engages a first fastener element to hold itself in a fixed, self-retaining position on the first fastener element prior to turning a second fastener element so that the wrench remains properly positioned for engagement with an adjacent part, allowing one person to tighten the fastener elements where a second person would have been required to hold the first fastener element against rotation; the provision of such a wrench which can be applied to a fastener element located in a confined space; and the provision of such a wrench which is economical to manufacture.

Generally, a wrench of this invention is designed for holding one fastening element (e.g., the bolt) of a nut-and-bolt type fastener against rotation while the other fastener element (e.g., the nut) is turned to tighten or loosen the fastener. The wrench comprises a wrench plate having a plurality of different size polygonal openings therein for fitting fastener elements of different sizes, the wrench plate being adapted to engage a part adjacent thereto when said other fastener element is turned for holding said one fastener element against rotation, and holding means affixed to one face of the wrench plate, the holding means projecting a relatively small distance beyond an edge of each opening for resilient engagement by said one fastener element when the latter is fitted in the opening, the resilient engagement holding the wrench plate in a fixed, self-retaining position with respect to said one fastener element prior to turning said other fastener element whereby both hands may be used to turn the latter for tightening or loosening the fastener.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
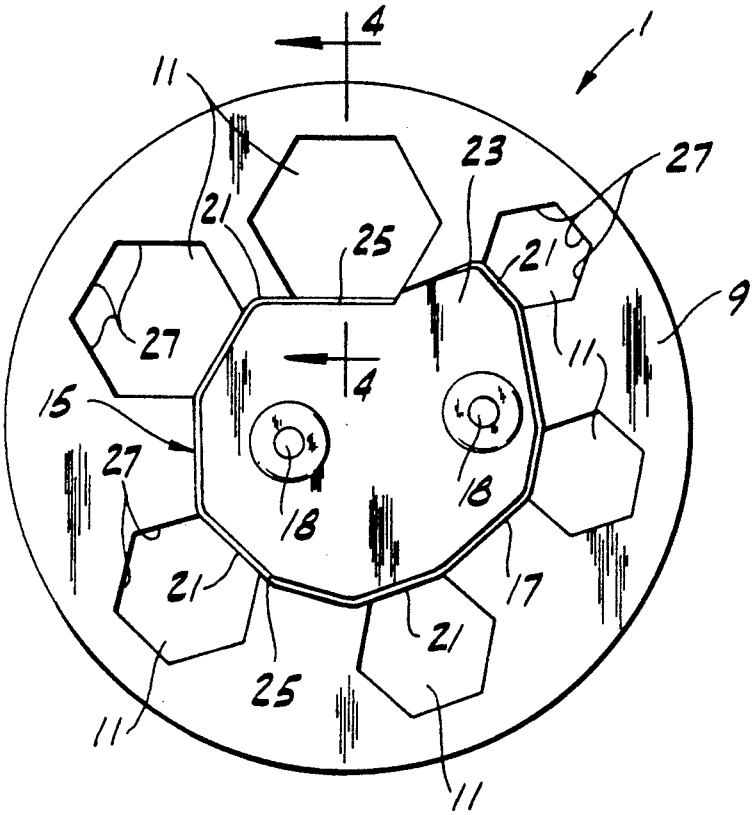
FIG. 1 is a plan view of a wrench of this invention.
Figure 2:
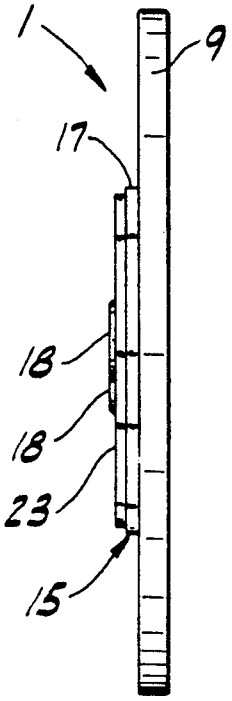
FIG. 2 is a right side elevation of FIG. 1.

Referring now to the drawings, there is generally indicated at 1 a wrench of the present invention which is useful in tightening or loosening nut-and-bolt fasteners of the type shown fastening the flanges F of two parts P together. Each fastener comprises nut-and-bolt fastener elements, one of which is shown as a standard hexagon-head bolt 5 and the other as a standard hexagon-shaped nut 7. Wrench 1 is designed for holding one of these fastener elements (e.g , bolt 5) against rotation while the other fastener element (e.g., nut 7) is turned by a conventional wrench (e.g., a socket wrench) to tighten or loosen the fastener.

As shown, wrench 1 comprises a circular wrench plate 9 of a suitable metal having a plurality of polygonal openings 11 therein spaced at intervals around the periphery of the plate. These openings 11 are of different sizes for fitting fastener elements (bolts 5 or nuts 7) of different sizes. For purposes of illustration, openings 11 are shown as being hexagon-shaped for fitting hexagon-head bolts and nuts, but it will be understood that this shape may vary for bolts and nuts of different configurations.

When fitted on a bolt 5 with the head 13 of the bolt received in the appropriate size opening 11, the wrench plate 9 is adapted to engage part P for holding the bolt against rotation as the nut is turned to tighten or loosen the fastener. In this regard, the position of the wrench plate on the bolthead is important. If the plate is canted on the bolthead when the nut is turned, the wrench plate will engage part P at an oblique angle, which tends to cause the plate to slip off the bolthead when any substantial amount of torque is applied to the nut. To ensure that the wrench plate 9 remains on the bolthead during tightening or loosening, it is preferable that the plate be disposed in a plane generally perpendicular to the axis of the bolt, so that the plate squarely engages both the part P and the bolthead 13. One way of ensuring that the wrench plate 9 is in proper position on the bolthead when the nut is turned is to hold it with one hand. However, this leaves only one hand free for turning the nut.

Figures 4, 6:
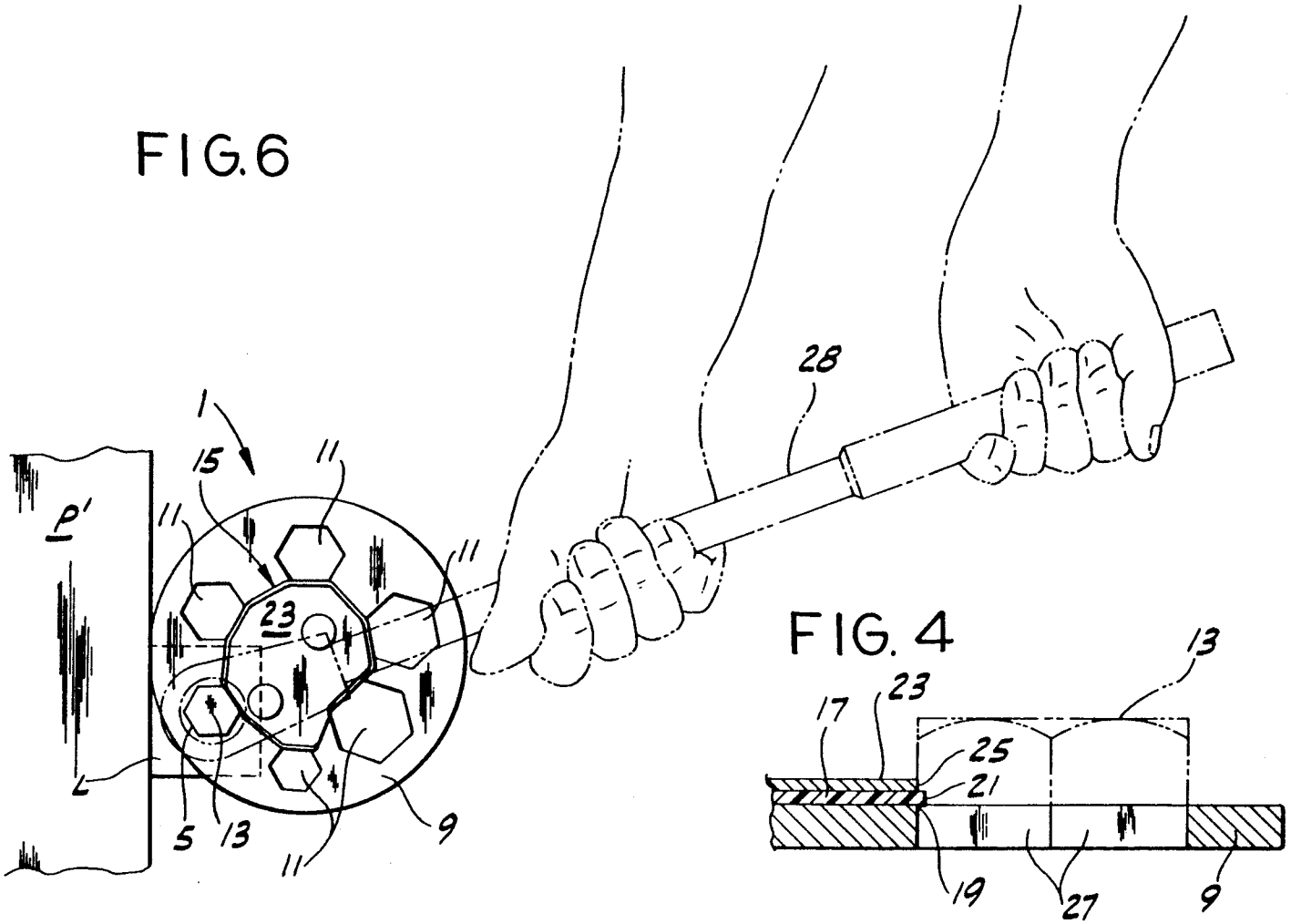
FIG. 4 is an enlarged fragmentary section taken in the plane including line 4—4 of FIG. 1.
FIGS. 5 and 6 are plan views illustrating how the wrench is used with a socket wrench to tighten a nut-and-bolt fastener.

In accordance with this invention, holding means generally indicated at 15 is provided for resilient engagement by one fastener element (e.g , bolt 5) when the latter is fitted in the opening 11 to hold the wrench plate 9 in fixed, self-retaining position with respect to the stated one fastener element prior to turning the other fastener element (e.g., nut 7). Means 15 comprises a relatively thin (e.g., 0.060 inches) sheet of resilient material 17, such as neoprene, affixed by fasteners 18 to one face of the wrench plate generally at the center. As shown in FIG. 4, the sheet 17 projects a relatively small distance (approximately 0.01 inches) beyond an edge 19 of each opening 11 and has a peripheral edge 21 which extends generally parallel to the edge 19 of each opening 11. A rigid (e.g., metal) reinforcing plate 23 is attached to the wrench plate 9 over the sheet of resilient material 17 so that the sheet is clamped between the reinforcing plate and the wrench plate for reinforcing the sheet of material. The reinforcing plate 23 has peripheral edges 25 substantially registering with the edge 19 of each opening 11 leaving exposed only the portion of the sheet 17 which projects beyond the edge 19.

Figure 3:
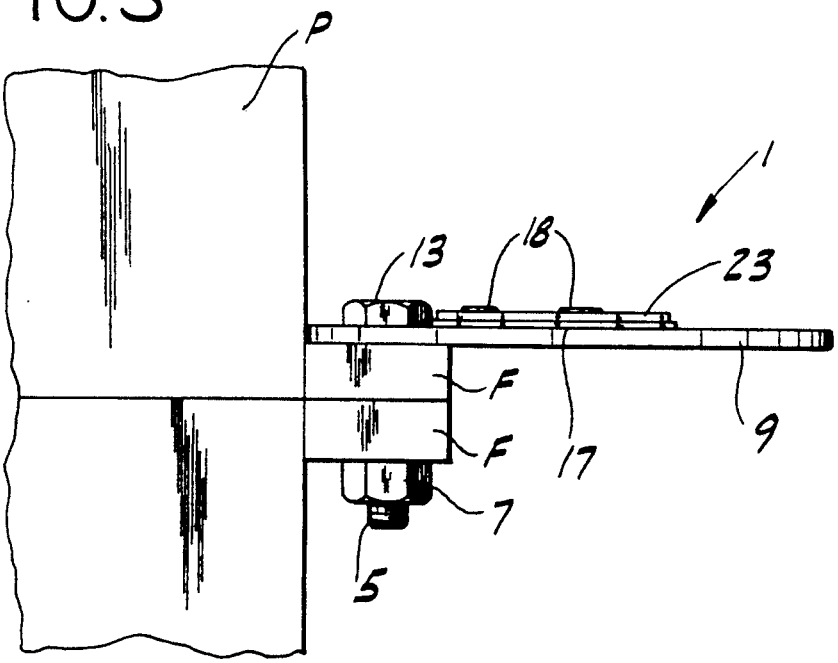
FIG. 3 is a side elevation showing the wrench holding a bolt against rotation.

As the bolthead 13 is fitted into the opening 11 of the wrench plate 9, as shown in FIG. 3, the side of the bolthead facing the edge 19 of the opening 11 engages the peripheral edge 21 of the sheet of resilient material 17, causing the resilient material to deform generally radially inwardly (the reinforcing plate 23 prevents the resilient material from being bent out of its plane). The size of the opening 11 is somewhat larger than the size of the bolthead 13 so that the bolthead may be easily fitted into the opening, and to allow for minor variations in the size of boltheads. The deformed resilient material 17 applies a force to the bolthead clamping it against the sides 27 of the wrench plate defining the opening 11. Thus the wrench plate is fixed in a generally square position on the bolthead without any further manipulation of the wrench. This is particularly advantageous when working spaces are confined such that it is difficult to reach one of the fastener elements. The fact that the wrench plate 9 is held in fixed, self-retaining position on the bolthead prior to turning the nut 7 leaves both hands free to turn the nut.

Figure 5:
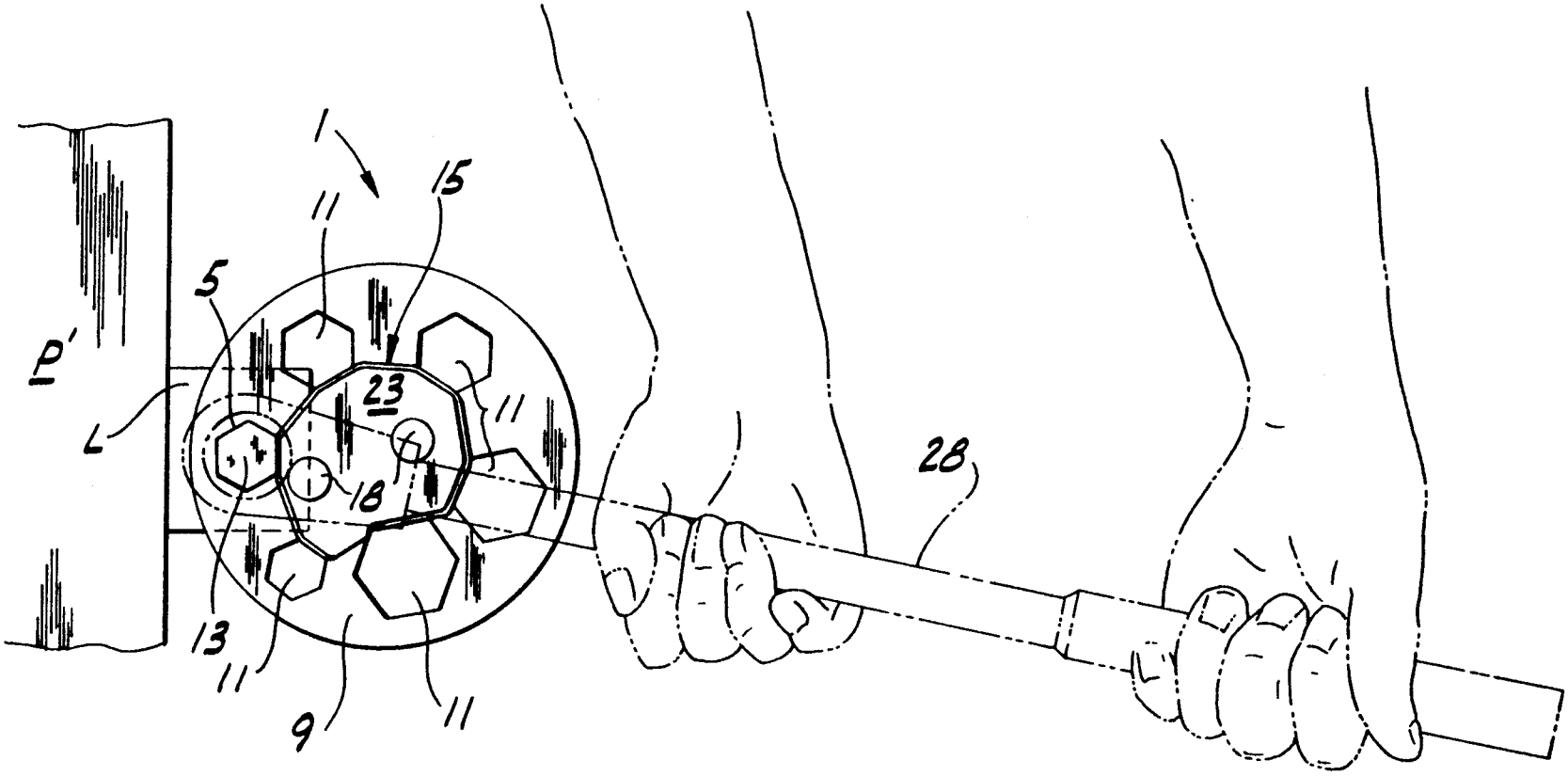

FIGS. 5–6 illustrate a typical way of using wrench 1 to tighten a nut-and-bolt fastener received through a lug L of a part P'. As illustrated in FIG. 5, the wrench 1 is first placed on the bolthead 13 with the latter in the appropriate size opening 11. The peripheral edge 21 of the resilient material engages the bolthead to hold the wrench plate square on the bolthead. With the wrench plate 9 held in position, both hands may be used to turn the nut 7 in the counterclockwise direction to tighten it. For example, where a socket wrench 28 is used to turn the nut 7, one hand may be used to hold the socket wrench on the nut, while the other hand applies torque to the nut. As the nut is rotated, the wrench plate squarely engages a part P' (FIG. 6) to hold the bolt against rotation, thereby ensuring relative rotation between the nut and bolt to tighten the fastener. If nut 7 is to be loosened rather than tightened, the process is similar to the one described above except that the wrench plate 9 turns clockwise as the nut is turned until the wrench plate engages the part.

Figure 7:
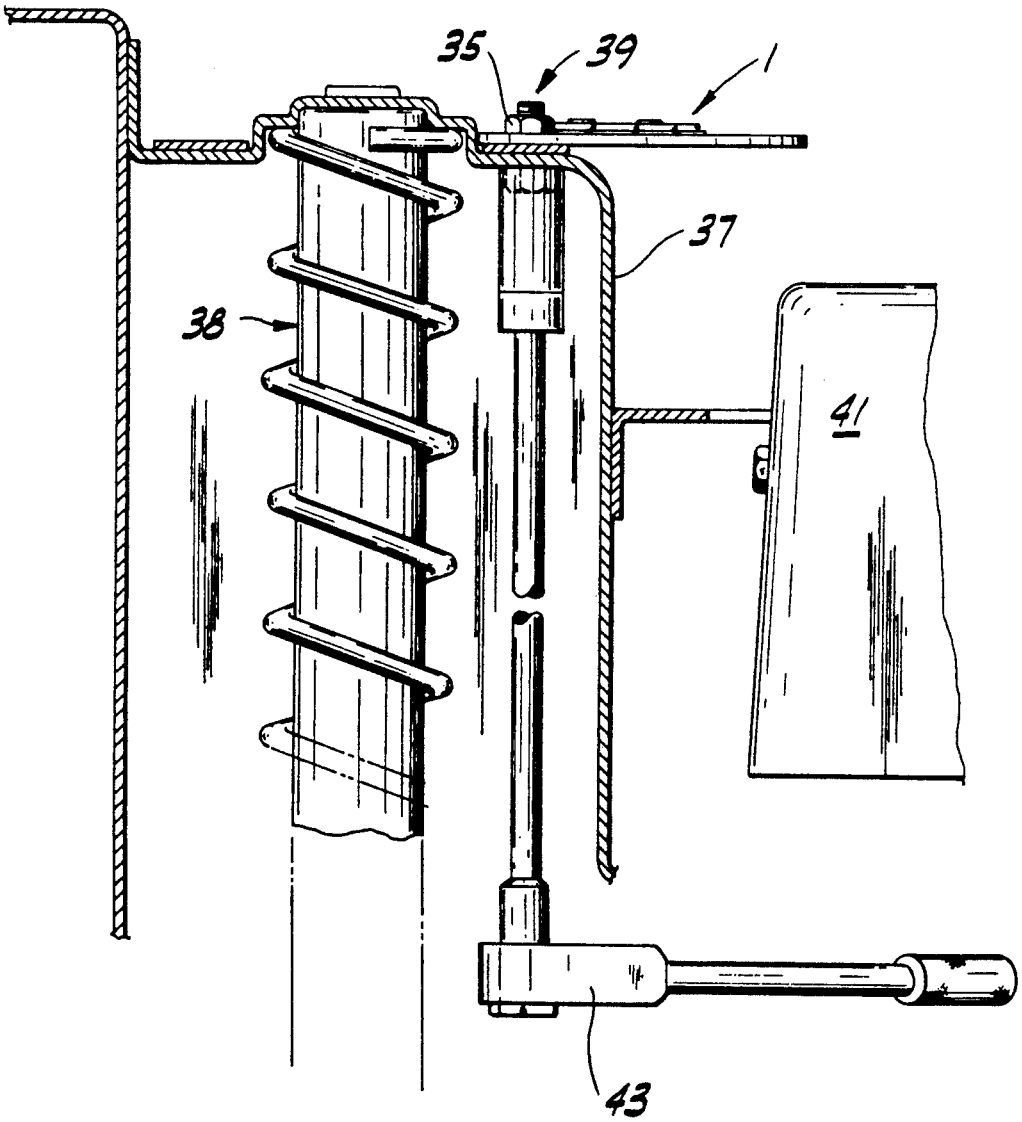
FIG. 7 is a partial section of housing for a strut mounted on the housing by a bolt tightened by the use of the wrench of this invention.

As shown in FIG. 7, the wrench 1 of this invention is applied to a nut 35 on the top of housing 37 for a strut, generally indicated at 38, of a vehicle. A fastener, generally indicated at 39, is used to mount the strut 38 on the housing. Another part 41 of the vehicle is connected to the side of the housing 37 such that it is impossible for one person to both turn the socket wrench 43 and reach the nut 35. Thus, without the wrench 1 of this invention, two people would be required to tighten the fastener 38, one to hold the nut 35 with a standard wrench and the other to turn the socket wrench 43. However, the wrench 1 of this invention may be first placed in self-retaining position on the nut 35 and then the socket wrench 43 may be applied to the bolt head 45. The wrench 1 holds the nut 35 against rotation, as described above, by engaging an adjacent part, in this instance the housing 37, so that the fastener 39 can be tightened by one person.

Figure 8:
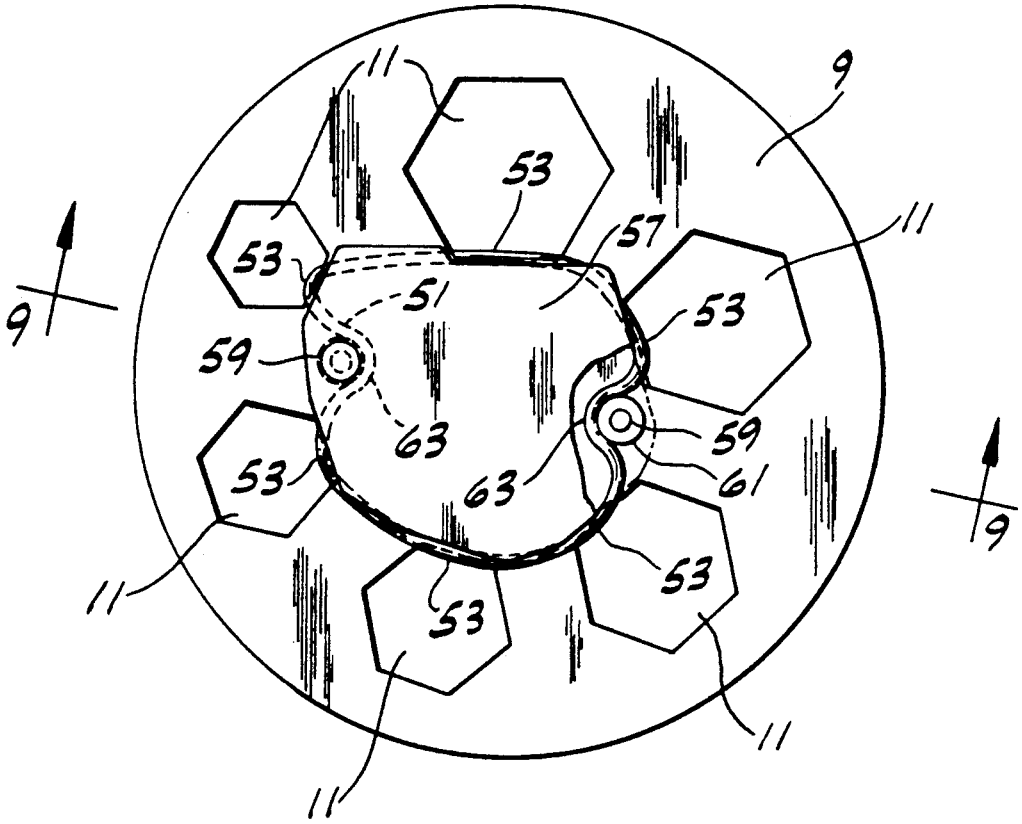
FIG. 8 is a plan view of an alternative embodiment of a wrench of this invention, with parts broken away to show detail.
Figure 9:
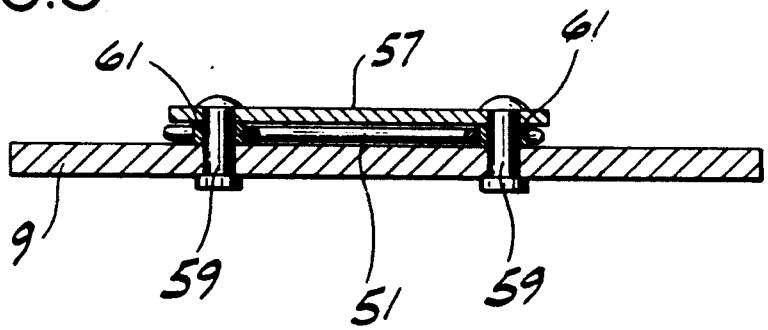
FIG. 9 is an enlarged fragmentary sectional view taken in the plane including line 4—4 of FIG. 8.

In another embodiment, shown in FIGS. 8 and 9, the sheet of resilient material 17 may be replaced by a wire spring 51 formed in a loop. A portion 53 of the wire spring 51 projects into each hexagonal opening 11 for resiliently engaging a fastener element such as the head of a bolt of a nut and bolt fastener received in the opening. A reinforcing plate 57 is mounted on the wrench plate 9 by rivet fasteners 59. The reinforcing plate 57 is substantially identical to the reinforcing plate 23 described above, and prevents the spring 51 from bending out of a plane parallel to the wrench plate 9 when engaged by the bolthead. Spacers 61 received on the rivet fasteners 59 space the reinforcing plate 57 from the wrench plate 9 a distance slightly greater than the thickness of the wire spring 51 so that the spring may flex inwardly without binding on the wrench plate or the reinforcing plate. As shown, the wire spring is bent as indicated at 63 to fit between the rivet fasteners 59 and thus is retained between the wrench plate 9 and the reinforcing plate 57.

Figure 10:
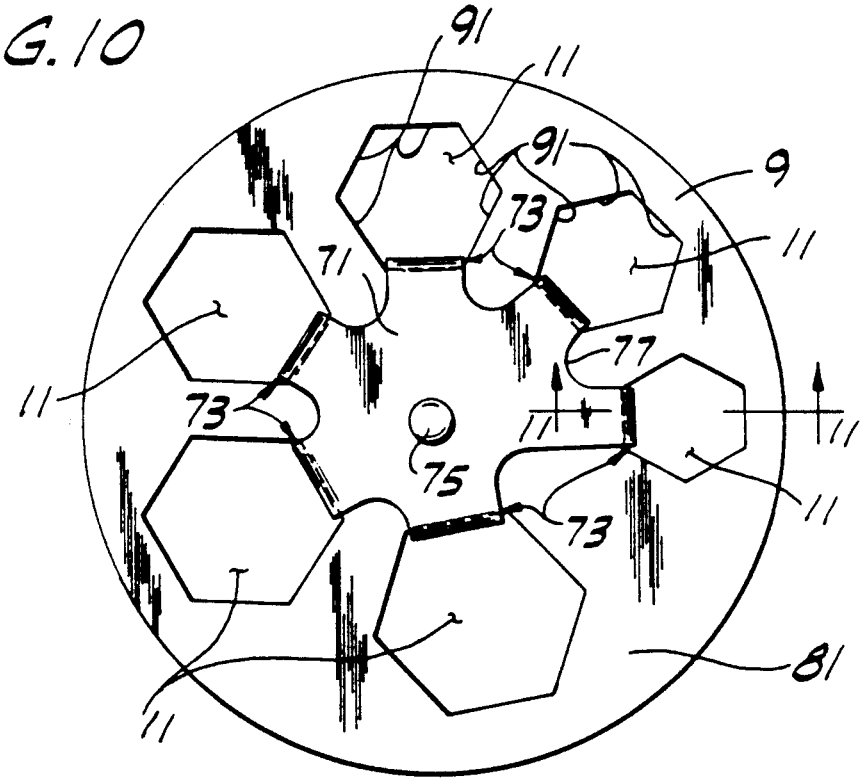
FIG. 10 is a plan view of another alternative embodiment of the wrench of this invention.
Figure 11:
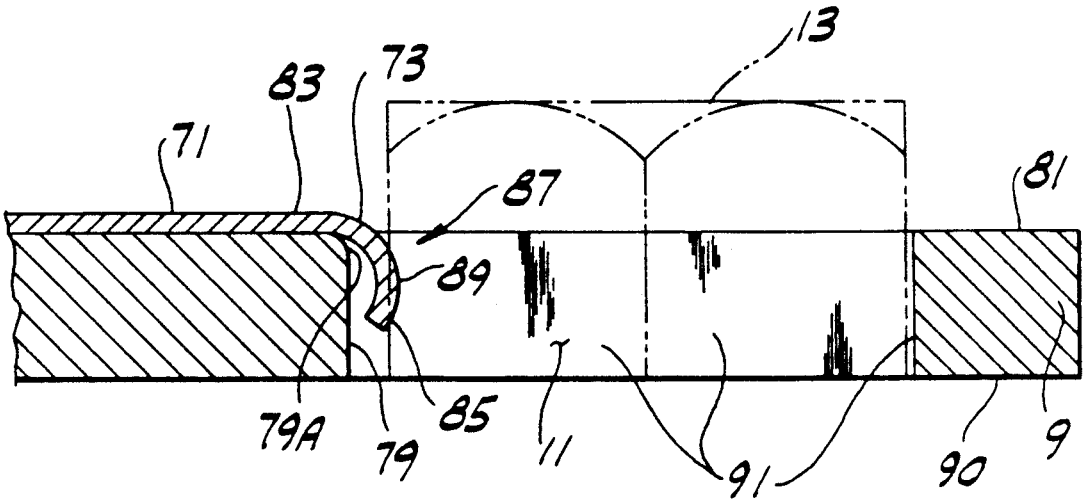
FIG. 11 is an enlarged fragmentary section taken in the plane including line 11—11 of FIG. 10.

Referring now to FIGS. 10 and 11, yet another embodiment of the wrench of the present invention is shown in which the sheet of resilient material 17 and reinforcing plate 23 of the first embodiment are replaced with a sheet metal member 71 of spring steel having at least one tab, generally indicated at 73, for each polygonal opening 11 in the wrench plate 9. The tabs 73 are formed integrally with the member 71 at its periphery. The member 71 is attached to the wrench plate 9 by a fastener 75, and the tabs 73 are bent to project generally radially outwardly with respect to the center of the circular wrench plate into respective openings 11. As will appear, these tabs function to hold the wrench plate in a fixed, self-retaining position with respect to a bolthead, for example. The member 71 has peripheral edges 77 of generally concave contour between adjacent tabs 73 to minimize stress on the tabs when subjected to loading by engagement with a fastener element such as the bolthead 13 of the bolt 5.

More specifically, each tab 73 is bent to extend from the top face 81 (as seen in FIG. 11) of the wrench plate 9 into a respective opening 11 generally adjacent the inner edge or wall 79 of the opening. Each tab 73 includes an inner portion 83 on the top face 81 of the wrench plate 9, an outer free end portion 85 and an intermediate portion, indicated generally at 87, connecting the inner and outer portions. The intermediate portion 87 extends into the opening 11 and has a fastener contact surface 89 adapted to resiliently flex inwardly upon engagement with the bolthead 13 as it enters the opening. In its flexed position, the tab 73 applies a force on the bolthead 13 sufficient to hold the wrench plate 9 in a fixed, self-retaining position with respect to the bolt during tightening and loosening of the nut 7 and bolthead 13.

The tab 73 is configured to facilitate entry of the bolthead 13 (fastener element) into the opening 11. The curved shape of the intermediate portion 87 guides the bolthead 13 into the opening 11 when it enters the opening from the top face 81 of the wrench plate 9. The radius of curvature of the intermediate portion is approximately 0.043 inches, although it is to be understood that the precise radius of curvature is not critical to the invention. As the bolthead 13 enters the opening 11, it is guided away from the inner wall 79 of the opening, and the tab 73 flexes inwardly toward the inner wall with the intermediate portion 87 flattening slightly from its curved configuration. The juncture of the inner wall 79 and the top face 81 of the wrench plate is radiused as indicated at 79A, so that the tab 73 flexes over a curved surface at the juncture rather than a sharp edge to reduce stress on the tab. The outer free end portion 85 of each tab 73 is flared for facilitating entry of the bolthead 13 into one of the openings 11 from a bottom face 90 (as shown in FIG. 11) of the wrench plate 9 in the same way as the curved intermediate portion 87 facilitates entry from the top face 81 of the wrench plate. Once the bolthead 13 is fully inserted into an opening 11, the wrench plate 9 is held on the bolthead by the engagement of the flexed contact surface 89 of the tab 73 with the bolthead, with the contact surface pinning the bolthead against one or more of the outer walls 91.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A wrench for holding a first fastener element of a nut-and-bolt fastener against rotation on an axis of the first fastener element while a second fastener element of the nut-and-bolt fastener is turned to tighten or loosen the fastener, said wrench comprising a generally circular wrench plate having a center and a plurality of different size polygonal openings therein spaced generally radially outwardly from said center for fitting fastener elements of different sizes, and holding means affixed to one face of the wrench plate and projecting generally radially outwardly with respect to the center of the wrench plate a relatively small distance beyond an inner edge of each opening for resilient engagement with the first fastener element when the latter is fitted in said opening, said resilient engagement holding the wrench plate in a fixed, self-retaining position in which the wrench plate is disposed in a plane generally perpendicular to said axis of rotation of the first fastener element, said wrench plate, when in said self-retaining position, being adapted to engage a part adjacent to the nut-and-bolt fastener when the second fastener element is turned, thereby holding the first fastener element against rotation on said axis and allowing both hands to be used to turn the second fastener element for tightening or loosening the nut-and-bolt fastener.

2. The wrench as set forth in claim 1 wherein said holding means comprises at least one tab for each polygonal opening in the wrench plate.

3. The wrench as set forth in claim 2 wherein the tab is bent to extend from said one face of the wrench plate into said opening generally adjacent said edge of said opening.

4. The wrench as set forth in claim 3 wherein said tab has a fastener contact surface in said opening adapted to resiliently flex upon engagement with a fastener element as the fastener element enters said opening.

5. The wrench as set forth in claim 3 wherein the tab is configured for facilitating entry of said fastener element into said opening.

6. The wrench as set forth in claim 2 wherein the tab comprises an inner portion on said one face of the wrench plate, an intermediate portion extending into the opening and having a fastener contact surface adapted to resiliently flex upon engagement with a fastener element as the fastener element enters said opening, and an outer free end portion.

7. The wrench as set forth in claim 6 wherein said outer free end portion of the tab is flared for facilitating entry of a fastener element into said opening.

8. The wrench as set forth in claim 6 wherein said intermediate portion has a curved configuration for guiding a fastener element into said opening.

9. The wrench as set forth in claim 2 wherein said holding means further comprises a sheet metal member having said tabs formed integrally therewith at the periphery of the member.

10. The wrench as set forth in claim 9 wherein the sheet metal member has a peripheral edge with a generally concave contour between adjacent tabs.

* * * * *